US008720526B1

(12) United States Patent
Campbell et al.

(10) Patent No.: US 8,720,526 B1
(45) Date of Patent: May 13, 2014

(54) PROCESS FOR FORMING A LONG GAS TURBINE ENGINE BLADE HAVING A MAIN WALL WITH A THIN PORTION NEAR A TIP

(71) Applicants: Christian X. Campbell, Charlotte, NC (US); Dimitrios Thomaidis, Berlin (DE)

(72) Inventors: Christian X. Campbell, Charlotte, NC (US); Dimitrios Thomaidis, Berlin (DE)

(73) Assignee: Siemens Energy, Inc., Orlando, FL (US)

( * ) Notice: Subject to any disclaimer, the term of this patent is extended or adjusted under 35 U.S.C. 154(b) by 0 days.

(21) Appl. No.: 13/675,345

(22) Filed: Nov. 13, 2012

(51) Int. Cl.
*B22D 46/00* (2006.01)

(52) U.S. Cl.
USPC ..... 164/4.1; 164/150.1; 164/154.1

(58) Field of Classification Search
USPC ..... 164/4.1, 69.1, 150.1, 154.1
See application file for complete search history.

(56) References Cited

U.S. PATENT DOCUMENTS

| | | | | |
|---|---|---|---|---|
| 3,935,766 | A | 2/1976 | Masters | |
| 4,811,253 | A * | 3/1989 | Johns | 702/168 |
| 4,959,523 | A | 9/1990 | Fihey et al. | |
| 5,446,673 | A | 8/1995 | Bauer et al. | |
| 6,376,801 | B1 | 4/2002 | Farrell et al. | |
| 6,388,223 | B2 | 5/2002 | Jones et al. | |
| 6,534,975 | B2 | 3/2003 | Beeck et al. | |
| 6,850,874 | B1 | 2/2005 | Higuerey et al. | |
| 6,968,290 | B2 | 11/2005 | Wei et al. | |
| 7,010,982 | B2 | 3/2006 | Bergman | |
| 7,272,529 | B2 | 9/2007 | Hogan et al. | |
| 7,891,248 | B2 | 2/2011 | Hough et al. | |
| 8,087,447 | B2 | 1/2012 | Propheter-Hinckley et al. | |
| 8,244,025 | B2 | 8/2012 | Davis et al. | |
| 2003/0037436 | A1 | 2/2003 | Ducotey, Jr. et al. | |
| 2003/0167616 | A1 | 9/2003 | Harding et al. | |
| 2008/0247636 | A1 | 10/2008 | Davis et al. | |
| 2008/0306620 | A1 | 12/2008 | Mutscheller | |
| 2009/0178482 | A1 | 7/2009 | Hough et al. | |
| 2009/0201971 | A1 | 8/2009 | Goldammer et al. | |
| 2009/0307628 | A1 | 12/2009 | Metala et al. | |
| 2011/0299990 | A1 | 12/2011 | Marra et al. | |

FOREIGN PATENT DOCUMENTS

| | | | |
|---|---|---|---|
| EP | 1759788 | A2 | 3/2007 |

* cited by examiner

*Primary Examiner* — Kevin P Kerns

(57) ABSTRACT

A process is provided for forming an airfoil for a gas turbine engine involving: forming a casting of a gas turbine engine airfoil having a main wall and an interior cavity, the main wall having a wall thickness extending from an external surface of the outer wall to the interior cavity, an outer section of the main wall extending from a location between a base and a tip of the airfoil casting to the tip having a wall thickness greater than a final thickness. The process may further involve effecting movement, using a computer system, of a material removal apparatus and the casting relative to one another such that a layer of material is removed from the casting at one or more radial portions along the main wall of the casting.

19 Claims, 5 Drawing Sheets

PROCESS FOR FORMING A LONG GAS TURBINE ENGINE BLADE HAVING A MAIN WALL WITH A THIN PORTION NEAR A TIP

This invention was made with U.S. Government support under Contract Number DE-FC26-05NT42644 awarded by the U.S. Department of Energy. The U.S. Government has certain rights to this invention.

FIELD OF THE INVENTION

The present invention relates to a process for forming a long gas turbine engine blade having a main wall with a thin portion near a tip.

BACKGROUND OF THE INVENTION

Due to high operating temperatures, gas turbine engine blades are typically formed from a high density, nickel-based superalloy. Due to typical large flowpath diameters of gas turbine engines, the linear velocity of tips of corresponding turbine blades is extremely high. Hence, material at each blade tip exerts large centrifugal forces on the remainder of the blade. Any extra material at the blade tip cascades down the blade increasing radial blade pull. In order to cast longer blades, it is desirable to reduce the wall thickness at the blade tip to reduce radial blade pull. It is difficult, though, to cast long turbine blades having thin-walled portions near the tips. This is because a ceramic core, used during the casting process, shifts within process tolerances during casting, resulting in an uncertain position of the core relative to the tip of the blade. Hence, during the design process, wall thickness reduction at or near the tip is limited because of core shifting during casting. If wall thickness is reduced too much, the core may break through the wall near the tip during casting.

SUMMARY OF THE INVENTION

In accordance with a first aspect of the present invention, a process is provided for forming an airfoil for a gas turbine engine comprising: forming a casting of a gas turbine engine airfoil having a main wall and an interior cavity, the main wall having a wall thickness extending from an external surface of the main wall to the interior cavity, an outer radial section of the main wall having a wall thickness greater than a final thickness; collecting, using a thickness measuring device, non-destructive first wall thickness data of the casting at the main wall outer section; comparing, using a computer system, the collected first wall thickness data with stored model thickness data to determine an initial amount of wall thickness material to be removed from the casting along the main wall outer section; and effecting movement of a material removal apparatus and the casting relative to one another such that a first layer of material is removed from the casting at a plurality of radial portions along the main wall outer section. Thereafter, the process may further comprise collecting, using the thickness measuring device, non-destructive second wall thickness data of the casting at the main wall outer section; comparing, using the computer system, the collected second wall thickness data with the stored model thickness data to determine an additional amount of wall thickness material to be removed along the main wall outer section; and effecting movement of the material removal apparatus and the casting relative to one another such that a second layer of material is removed from a subset of the plurality of radial portions along the main wall outer section.

The thickness measuring device may comprise one of an ultrasonic device, an X-ray inspection apparatus, an eddy current measurement apparatus and a thermal imaging device.

The airfoil casting may define a gas turbine engine blade and the main wall outer section may extend from a location between a base and a tip of the airfoil casting to the tip.

The subset of the plurality of radial portions along the main wall outer section may extend to the tip of the airfoil casting.

The material removal apparatus may comprise a grit blasting apparatus emitting a working fluid comprising an abrasive grit in a fluid medium against the casting. The grit blasting apparatus may spray the working fluid at the casting at a non-orthogonal angle to the external surface of the main wall of the casting.

The casting may define a gas turbine engine blade have an airfoil length of from about 26 inches to about 35 inches.

In accordance with a second aspect of the present invention, a process is provided for forming an airfoil for a gas turbine engine comprising: forming a casting of a gas turbine engine airfoil having a main wall and an interior cavity, the main wall having a wall thickness extending from an external surface of the main wall to the interior cavity, an outer radial section of the main wall extending from a location between a base and a tip of the airfoil casting to the tip and having a wall thickness greater than a final thickness; collecting, using a thickness measuring device, non-destructive wall thickness data of the casting; comparing, using a computer system, the collected wall thickness data with stored model thickness data to determine a desired amount of wall thickness material to be removed from one or more radial portions along the outer section of the main wall of the casting; effecting movement of a material removal apparatus and the casting relative to one another such that a layer of material is removed from the casting at one or more radial portions along the main wall of the casting; and repeating the collecting, comparing and effecting steps one or more times until the outer section of the main wall of the casting has a desired thickness.

Wherein the repeating of the collecting, comparing and effecting steps one or more times preferably result in the thickness of the outer section of the main wall of the casting varying along the length of the outer section and, preferably, varying in a generally smooth continuous manner from the location between the base and the tip to the tip.

The thickness of the outer section of the main wall near the tip may be less than the thickness of the outer section at the location between the base and the tip of the airfoil casting.

Preferably, material is only removed from the casting at the outer section of the main wall.

BRIEF DESCRIPTION OF THE DRAWINGS

While the specification concludes with claims particularly pointing out and distinctly claiming the present invention, it is believed that the present invention will be better understood from the following description in conjunction with the accompanying Drawing Figures, in which like reference numerals identify like elements, and wherein:

DETAILED DESCRIPTION OF THE INVENTION

In the following detailed description of the preferred embodiment, reference is made to the accompanying drawings that form a part hereof, and in which is shown by way of illustration, and not by way of limitation, a specific preferred embodiment in which the invention may be practiced. It is to be understood that other embodiments may be utilized and that changes may be made without departing from the spirit and scope of the present invention.

Figure 1:
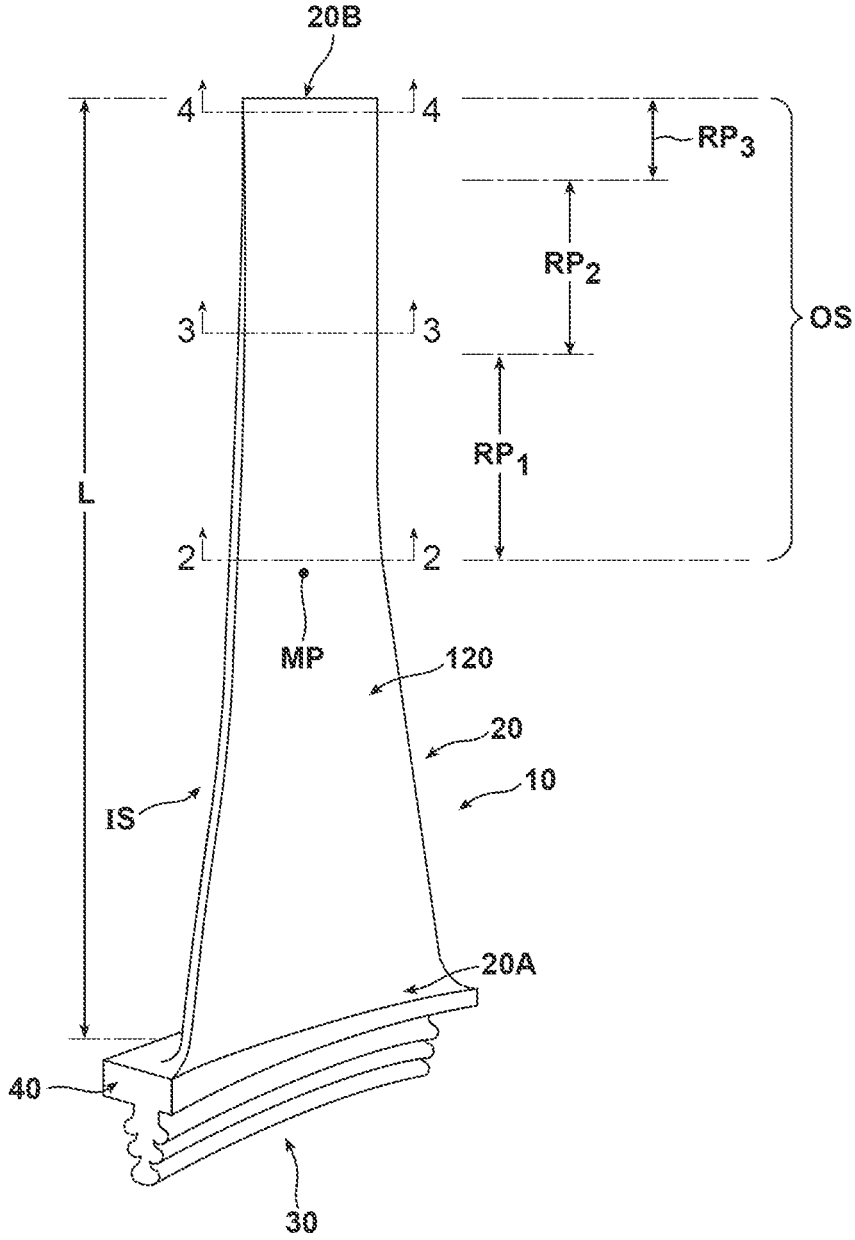
FIG. 1 is a perspective view of a blade having a final thickness formed using the process of the present invention.

Referring now to FIG. 1, a turbine blade 10 formed in accordance with a process of the present invention is illustrated. The blade 10 is adapted to be used in a turbine section (not shown) of a gas turbine engine (not shown). Within the turbine section are a series of rows of stationary vanes and rotating blades. Typically, there are four rows of blades in a turbine section. It is contemplated that the blade 10 illustrated in FIG. 1 may define the blade configuration for a third or fourth row of blades in the turbine section.

The blades are coupled to a shaft and disc assembly (not shown). Hot working gases from a combustor section (not shown) in the gas turbine engine travel to the rows of blades. As the working gases expand through the turbine section, the working gases cause the blades, and therefore the shaft and disc assembly, to rotate.

The turbine blade 10 comprises an airfoil 20, a root 30 and a platform 40, which, in the illustrated embodiment, may be formed as a single integral unit from an alloy material such as a metal alloy 247. The root 30 functions to couple the blade 10 to the shaft and disc assembly in the turbine section. The airfoil 20 comprises a main wall 120 extending radially from the root 30. The main wall 120 defines a first generally concave pressure sidewall 122 and a second generally convex suction sidewall 124, see FIG. 2. The first and second sidewalls 122 and 124 are joined together at a leading edge 126 and a trailing edge 128. The main wall 120 also defines, in the illustrated embodiment, a plurality of interior cavities 130. The main wall 120, near the cavities 130, has a wall thickness extending from an external surface 120A of the main wall 120 to an interior cavity 130.

In the illustrated embodiment, the main wall 120 comprises a mid-point MP located between a base 20A of the airfoil 20 and a tip 20B of the airfoil, see FIG. 1. The main wall 120 further comprises an outer radial section OS extending from a location near the mid-point MP to the tip 20B. The outer radial section OS is defined in the embodiment illustrated in FIG. 1 as comprising first, second and third radial portions $RP_1$-$RP_3$. Each radial portion may define a resolution of a machining process of the present invention. For ease of illustration, only three radial portions $RP_1$-$RP_3$ are provided in the embodiment of FIG. 1. However, it is contemplated that a higher resolution will be desirable such that many more than three radial portions will be defined. In any event, the number of radial portions can be defined as comprising less than three portions or more than three portions.

Figure 2:
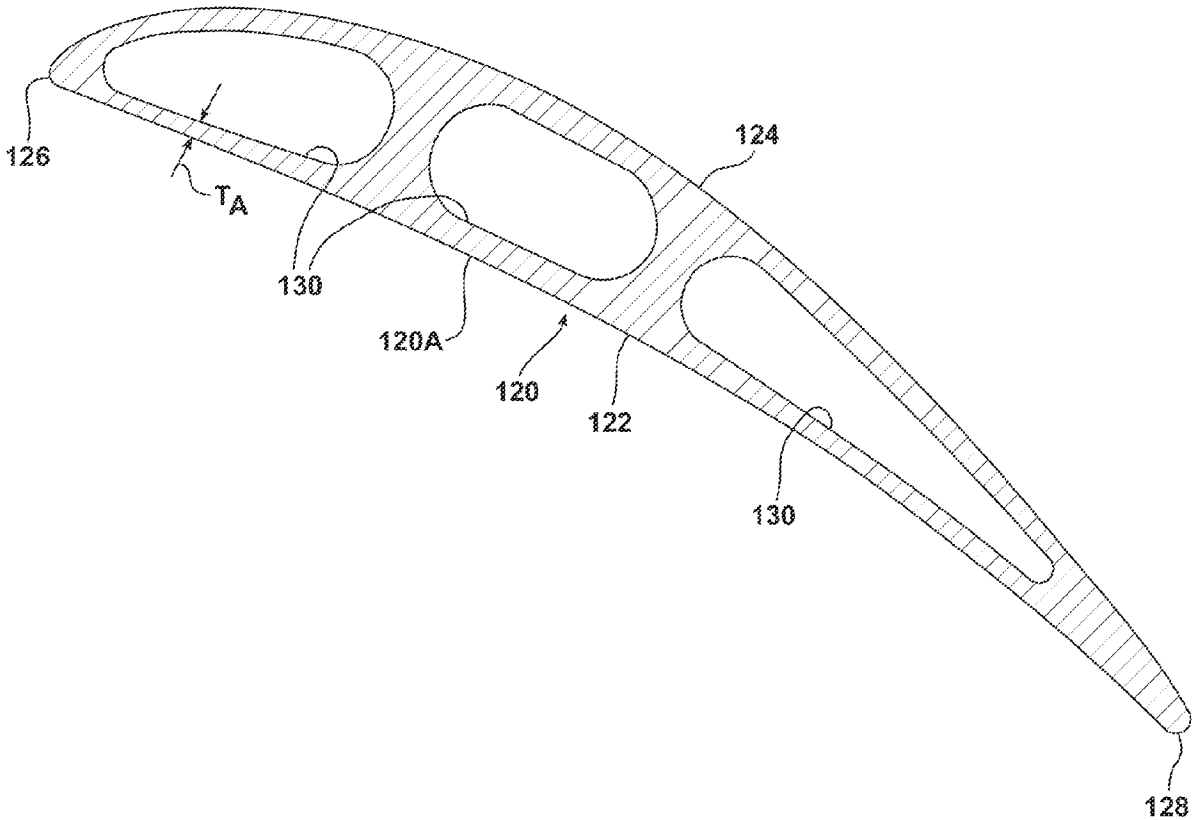
FIGS. 2-4 are cross sectional views taken along view lines 2-2, 3-3 and 4-4 in FIG. 1.
Figure 3:
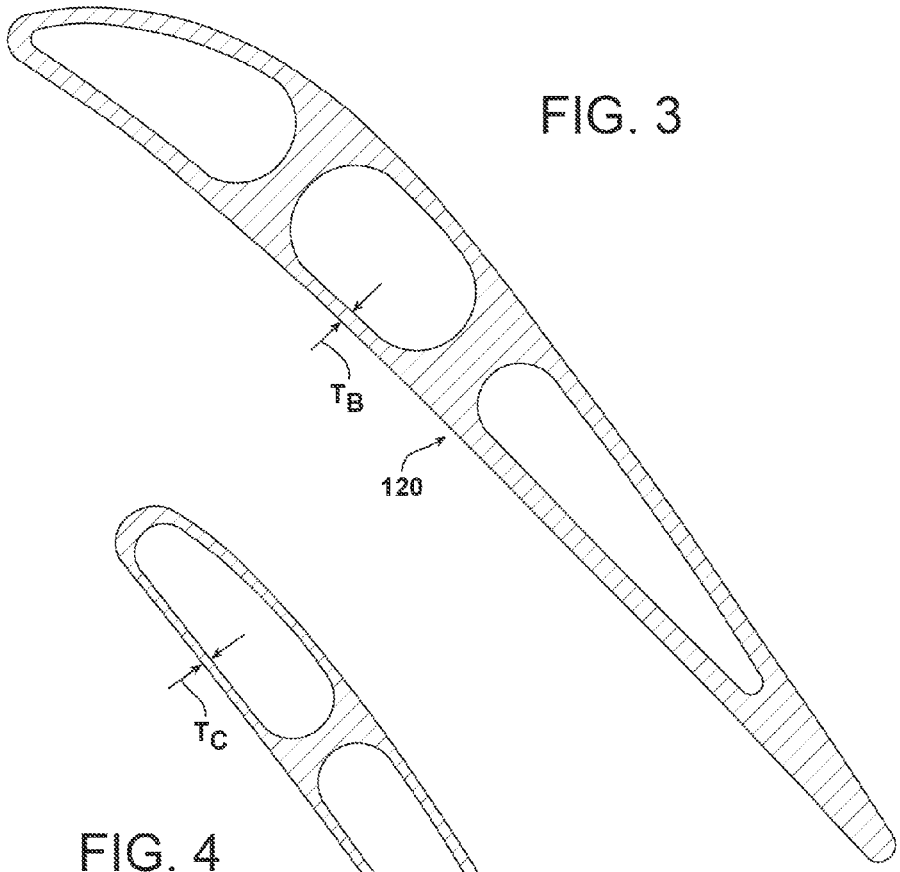
Figure 4:
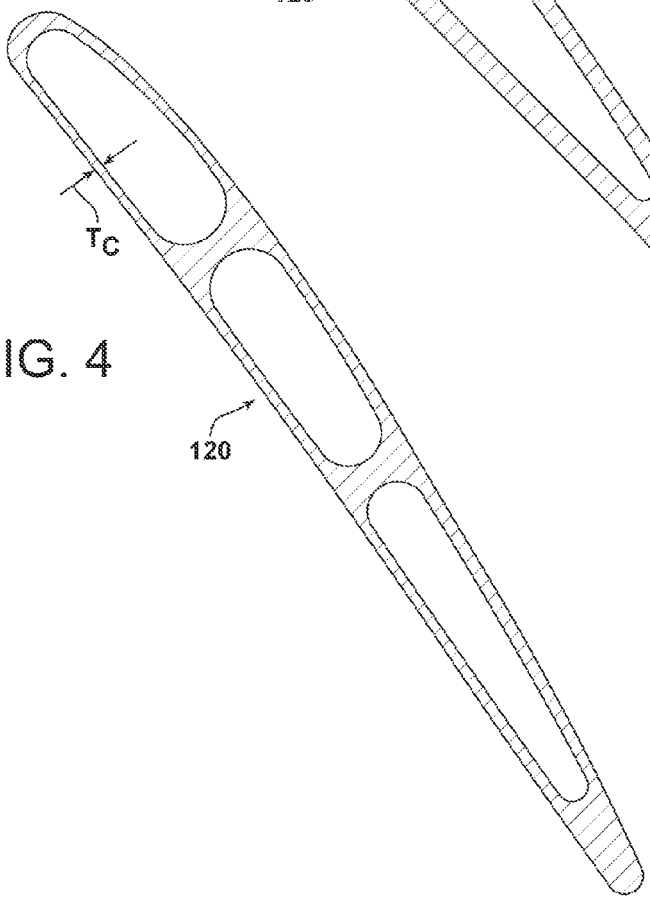

The outer section OS has a final wall thickness that generally varies along its length such that the final thickness is greatest near the mid-point MP, see thickness $T_A$ in FIG. 2, and gradually decreases to a minimum thickness near the tip 20B, see thickness $T_C$ in FIG. 4. A thickness $T_B$ at an intermediate location along the outer section OS is illustrated in FIG. 3 and is less than thickness $T_A$ but greater than thickness $T_C$ near the tip 20B such that $T_A>T_B>T_C$. For an airfoil having a length L of from about 26 inches to about 35 inches, the thickness $T_C$ near the tip 20B may fall within a range of from about 0.7 mm to about 1.5 mm.

As noted above, casting an airfoil having a long length L with a thickness of the main wall being very thin near the airfoil tip is difficult. In accordance with the present invention, an airfoil is cast such that the main wall thickness at the outer section OS is greater than a final thickness, i.e., the main wall thickness is cast so as to be overly thick. For example, the outer radial section OS may be cast such that it has a substantially constant thickness when moving radially from near the mid-point MP to the tip 20B such that the additional main wall material gradually increases in a generally continuous manner when moving radially from near the mid-point MP to the tip 20B. Preferably, the main wall thickness of an inner radial section IS of the airfoil 20 extending from the base 20A to or near the mid-point MP is cast to the final thickness for the inner section IS such that no material removal from the inner section IS is required. Subsequently, the outer section OS of the airfoil casting is machined to a final desired thickness taking into account the locations of the interior cavities 130 formed via ceramic cores during the casting operation.

Figure 7:
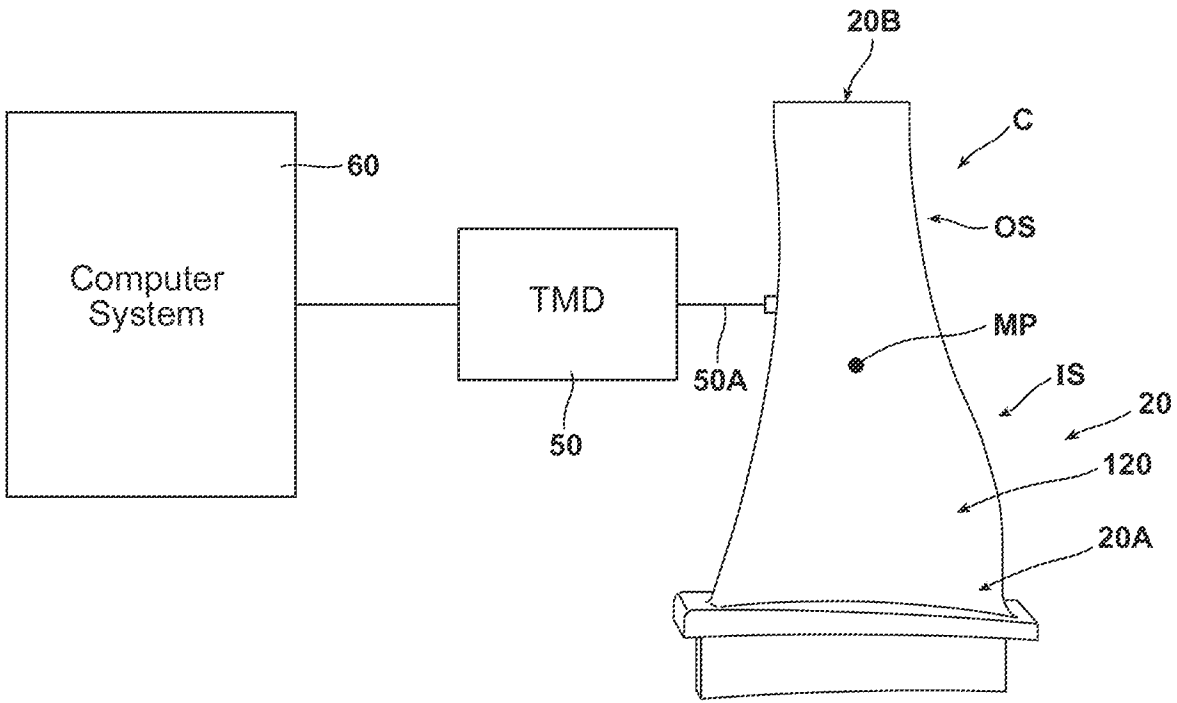
FIG. 7 is a view illustrating a conventional measuring apparatus, a computer system and a blade casting.

In FIG. 7, a casting C of the blade is illustrated. A conventional thickness measuring device TMD is provided, which, in the illustrated embodiment comprises an ultrasonic measuring device 50 having a sonic thickness probe 50A for measuring the thickness of the outer section OS of the main wall 120 at any point such that non-destructive wall thickness data is collected from the casting C and provided to a computer system 60. It is also contemplated that the thickness measuring device may comprise any other known device, such as an X-ray inspection measuring apparatus, an eddy current measurement apparatus or a thermal imaging measuring device. The computer system 60 has stored in its memory model thickness data for all locations of the outer section OS of the airfoil 20. Hence, the computer system 60 compares the collected wall thickness data for the main wall outer section OS with the stored model thickness data to determine a desired amount of wall thickness material to be removed from the main wall outer section OS. The computer system 60 also takes into account the locations of the interior cavities 130 relative to the main wall external surface 120A so that a desired minimum main wall thickness is always maintained between the external surface 120A and an interior cavity 130.

Figure 5:
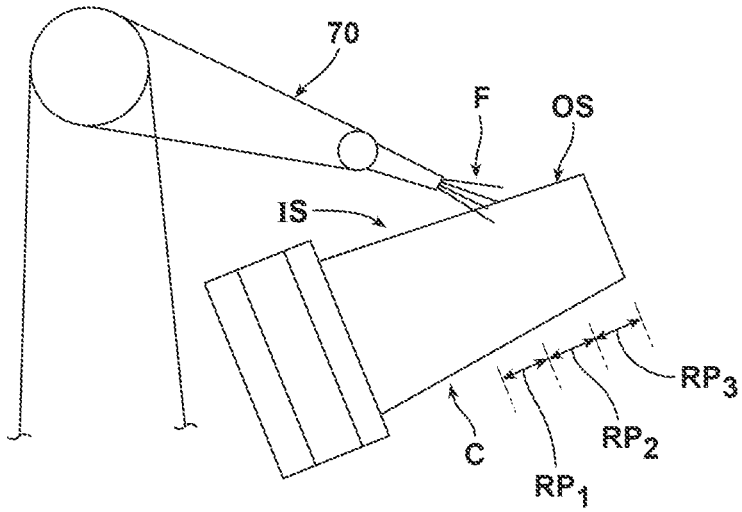
FIGS. 5 and 6 are views of a grit blasting apparatus removing material from radial portions of an outer section of a main wall of a blade casting.
Figure 6:
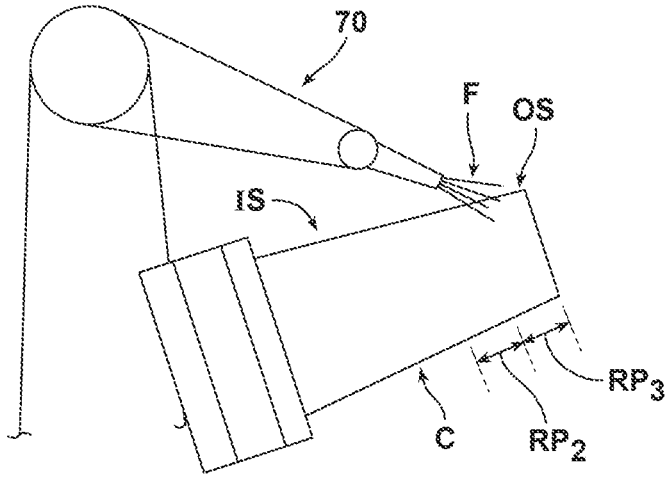

In accordance with the illustrated embodiment, the material removal device comprises a grit blasting apparatus 70, see FIGS. 5 and 6. The grit blasting apparatus 70 may spray a working fluid F comprising an abrasive grit, such as alumina, sand or the like, in a fluid medium, such as air or water, against the casting C. The grit blasting apparatus 70 preferably sprays the working fluid at the casting C at a non-orthogonal angle to an external surface of the main wall of the casting C. It is contemplated that the grit blasting working fluid F may strike the casting C in a circular area or footprint having a diameter of from about 0.125 inch to about 1 inch. It is also contemplated that other known material removal devices may be used in place of the grit blasting apparatus 70, such as a belt sander.

Preferably, the grit blasting apparatus 70 is used to remove material from the outer section OS of the main wall 120 on a layer by layer basis. The grit blasting apparatus 70 may be moved relative to the casting C, which may be held stationary via a fixture (not shown) or the casting C may be moved relative to the grit blasting apparatus 70. Movement of the grit blasting apparatus 70 and/or the casting C may be effected using a conventional moving device, which may be controlled via the computer system 60. It is contemplated that each layer of material removed from the casting C may have a thickness of from about 0.05 mm to about 0.25 mm.

As noted above, three radial portions $RP_1$-$RP_3$ are illustrated in FIG. 1, but, in order to increase the resolution of the material removal operation, more than three radial portions may be provided. Each radial portion may be defined to have a radial dimension substantially equal to the diameter or footprint of the grit blasting working fluid F striking the casting C. Hence, the grit blasting working fluid F may move repeatedly in a direction transverse to the radial direction to remove one or more layers of material from one or more of the radial portions.

As illustrated in FIG. 5, a first layer of material may be removed via the grit blasting apparatus from a plurality or all points or locations on each of the first, second and third radial portions $RP_1$-$RP_3$ of the outer section OS. The term "layer" is intended to encompass a layer that is either uniform or varies in thickness in a direction transverse to the radial direction, e.g., in a direction extending from the leading edge 126 to the trailing edge 128. Hence, when a layer of material is removed from one of the first, second and third radial portions $RP_1$-$RP_3$, the amount of material removed in that layer may be uniform or vary in thickness in a direction transverse to the radial direction. It is also contemplated that a layer of material may be removed from only a transverse section of a radial portion such that no material is removed from one or more remaining transverse sections of the radial portion. The transverse sections of the radial portion may extend from the leading edge 126 to the trailing edge 128. After the first layer of material has been removed from the first, second and third radial portions $RP_1$-$RP_3$, the ultrasonic measuring device 50 measures the thickness of the outer section OS of the main wall 120 at all points and provides updated wall thickness data to the computer system 60. The computer system 60 compares the updated measured wall thickness data with the stored model thickness data so as to determine any additional material to be removed from the outer section OS. For example, since the final wall thickness becomes thinner in a radial direction from near the mid-point MP to the tip 20B, it may not be necessary to remove any further material from the first radial portion $RP_1$, yet one or more layers of material may still need to be removed from the second and third radial portions $RP_2$ and $RP_3$. In FIG. 6, the grit blasting apparatus 70 is illustrated as removing a further layer of material from both the second and third radial portions $RP_2$ and $RP_3$, while not removing material from the first radial portion $RP_1$. The process of measuring the thickness of the outer section OS of the main wall 120, comparing the measured thickness data with the stored model thickness data and removing an additional layer of material from the main wall 120 may be repeated numerous times until all points along the outer section OS, i.e., along the first, second and third radial portions $RP_1$-$RP_3$, are at a desired final thickness.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A process for forming an airfoil for a gas turbine engine comprising:

forming a casting of a gas turbine engine airfoil having a main wall comprising a concave side wall and a convex side wall and defining an interior cavity between the concave side wall and the convex side wall, the main wall having a wall thickness extending from an external surface of the main wall to an internal surface of the main wall adjacent to the interior cavity, an outer radial section of the main wall having a wall thickness greater than a final thickness;

collecting, using a thickness measuring device, non-destructive first wall thickness data of the casting at the main wall outer section;

comparing, using a computer system, the collected first wall thickness data with stored model thickness data to determine an initial amount of wall thickness material to be removed from the casting along the main wall outer section;

effecting movement of a material removal apparatus and the casting relative to one another such that a first layer of material is removed from the casting at a plurality of radial portions along the main wall outer section; thereafter, collecting, using the thickness measuring device, non-destructive second wall thickness data of the casting at the main wall outer section;

comparing, using the computer system, the collected second wall thickness data with the stored model thickness data to determine an additional amount of wall thickness material to be removed along the main wall outer section; and effecting movement of the material removal apparatus and the casting relative to one another such that a second layer of material is removed from a subset of the plurality of radial portions along the main wall outer section.

2. The process as set out in claim 1, wherein the measuring device comprises one of an ultrasonic device, an X-ray inspection apparatus, an eddy current measurement apparatus and a thermal imaging device.

3. The process as set out in claim 1, wherein said airfoil casting defines a gas turbine engine blade and said main wall outer section extends from a mid-point location between a base and a tip of the airfoil casting to the tip and has a substantially constant wall thickness when moving radially from near the midpoint location out to the tip.

4. The process as set forth in claim 3, wherein the subset of the plurality of radial portions along the main wall outer section extend to the tip of the airfoil casting.

5. The process as set out in claim 1, wherein said material removal apparatus comprises a grit blasting apparatus.

6. The process as set out in claim 5, wherein said grit blasting apparatus sprays a working fluid comprising an abrasive grit in a fluid medium against the casting.

7. The process as set forth in claim 6, wherein said grit blasting apparatus sprays the working fluid at the casting at a non-orthogonal angle to the external surface of the main wall of the casting.

8. The process as set forth in claim 1, wherein said casting defines a gas turbine engine blade have an airfoil length of from about 26 inches to about 35 inches.

9. The process as set forth in claim 1, wherein material is only removed from a transverse section of a radial portion.

10. A process for forming an airfoil for a gas turbine engine comprising:

forming a casting of a gas turbine engine airfoil having a main wall comprising a concave side wall and a convex side wall and defining an interior cavity between the concave side wall and the convex side wall, the main wall having a wall thickness extending from an external surface of the main wall to an internal surface of the main wall adjacent to the interior cavity, an outer radial section of the main wall extending from a location between a base and a tip of the airfoil casting to the tip having a wall thickness greater than a final thickness;

collecting, using a thickness measuring device, non-destructive wall thickness data of the casting;

comparing, using a computer system, the collected wall thickness data with stored model thickness data to determine a desired amount of wall thickness material to be removed from one or more radial portions along the outer section of the main wall of the casting;

effecting movement of a material removal apparatus and the casting relative to one another such that a layer of material is removed from the casting at one or more radial portions along the main wall of the casting; and repeating the collecting, comparing and effecting steps one or more times until the outer section of the main wall of the casting has a desired thickness.

11. The process as set out in claim 10, wherein said measuring device comprises one of an ultrasonic device, an X-ray inspection apparatus, an eddy current measurement apparatus and a thermal imaging device.

12. The process as set out in claim 10, wherein said airfoil casting defines a gas turbine engine blade.

13. The process as set out in claim 10, wherein said material removal apparatus comprises a grit blasting apparatus.

14. The process as set out in claim 13, wherein said grit blasting apparatus sprays a working fluid comprising an abrasive grit in a fluid medium against the casting.

15. The process as set forth in claim 14, wherein said grit blasting apparatus sprays the working fluid at the casting at a non-orthogonal angle to a surface of the casting.

16. The process as set forth in claim 10, wherein repeating the collecting, comparing and effecting steps one or more times results in the thickness of the outer section of the main wall of the casting varying along the length of the outer section.

17. The process as set forth in claim 16, wherein the thickness of the outer section of the main wall near the tip is less than the thickness of the outer section at the location between the base and the tip of the airfoil casting.

18. The process as set forth in claim 16, wherein an inner radial section of the main wall extending from the base to a mid-point location is cast so as to have a substantially final thickness such that material is only removed from the casting at the outer section of the main wall.

19. The process as set forth in claim 10, wherein material is only removed from a transverse section of a radial portion.

* * * * *